US005460655A

United States Patent [19]

Pisacane et al.

[11] Patent Number: 5,460,655

[45] Date of Patent: Oct. 24, 1995

[54] HYDROPHILIC FOAM ARTICLE AND SURFACE-CLEANING METHOD FOR CLEAN ROOM

[75] Inventors: Ferdinand F. Pisacane, Laguna Beach; Alan R. Seacord, Descanso, both of Calif.

[73] Assignee: Wilshire Technologies, Inc., Carlsbad, Calif.

[21] Appl. No.: 187,763

[22] Filed: Jan. 27, 1994

[51] Int. Cl.[6] ..... B08B 1/00; B08B 7/00; B08B 9/04; A47L 13/16

[52] U.S. Cl. ..... 134/6; 134/8; 134/22.11; 134/7; 15/244.1; 15/244.4; 15/230; 15/230.11

[58] Field of Search ..... 134/7, 6, 8, 22.11; 15/244.1, 244.4, 230, 230.11

[56] References Cited

U.S. PATENT DOCUMENTS

| | | | |
|---|---|---|---|
| 2,906,650 | 10/1956 | Wheaton | 134/8 |
| 3,002,937 | 10/1961 | Parker et al. | 15/244.4 |
| 3,119,600 | 12/1961 | Bitter | 254/134.4 |
| 3,120,947 | 2/1964 | Hamrick | 254/134.4 |
| 3,277,508 | 10/1966 | Knapp | 15/104.06 |
| 4,566,911 | 1/1986 | Tomita et al. | 134/6 |
| 4,888,229 | 12/1989 | Paley et al. | 428/192 |
| 5,032,185 | 7/1991 | Knapp | 134/22.11 |

*Primary Examiner*—Jan H. Silbaugh
*Assistant Examiner*—Zeinab El-Arini
*Attorney, Agent, or Firm*—Dressler, Goldsmith, Shore & Milnamow, Ltd.

[57] ABSTRACT

A novel method and a novel article for cleaning a metal, glass, or plastic surface without scratching or scoring the surface. The novel method includes wiping the surface with the novel article, which is made from an open cell, hydrophilic, static-dissipative, polyurethane foam, and which is laundered so that the article in deionized water releases fewer than $36.0\times10^6$ per square meter of apparent surface area of the article for particles of a size greater than about 0.5 μm and fewer than about 2.5 parts per million of chloride, fluoride, sodium, sulfate, sulfite, or silicon ions. The novel article may be a wiper, a sponge, a roller, a swab mounted on a handle, or a plug having a generally cylindrical shape when unstressed and having particular utility where the surface is the interior surface of a metal, glass, or plastic tube. The plug is propelled through the tube, as by means of compressed air. The novel method also may include washing the surface with deionized water.

10 Claims, 1 Drawing Sheet

HYDROPHILIC FOAM ARTICLE AND SURFACE-CLEANING METHOD FOR CLEAN ROOM

TECHNICAL FIELD OF THE INVENTION

This invention pertains to a novel article and to a method employing such an article for cleaning a metal, glass, or plastic surface, as in a clean room, without scratching or scoring the surface. The novel article is made from an open cell, hydrophilic, static-dissipative, polyurethane foam and is prepared so as to minimize potential release of potentially destructive particles and of potentially deleterious ions.

BACKGROUND OF THE INVENTION

In clean rooms where semiconductors, magnetic storage media, or thin film circuits are produced and in clean rooms where pharmaceuticals are produced, similar cleaning problems are encountered. Frequently, it is necessary to clean a metal, glass, or plastic surface so as to remove metal and other particulates, and so as to remove organic and other residues. As an example, after a metal pipe has been installed in a clean room, it is necessary to clean the interior surface of the metal pipe so as to remove metal particles resulting from prior manufacturing, cutting, or facing operations.

Known methods for cleaning metal, glass, or plastic surfaces in clean rooms have employed polyester filamentary wipers, as exemplified in Paley et al. U.S. Pat. No. 4,888,229, or polyvinyl alcohol or polyvinyl acetal rollers, as exemplified in Tomita et al. U.S. Pat. No. 4,566,911. Cotton wipers and other filamentary wipers have been also employed, as well as other cleaning articles of diverse materials, such as sponges and swabs.

Commonly, in clean rooms, metal, glass, or plastic tubes of small interior diameters are installed. A known method for cleaning the interior surface of such a tube in a clean room has comprised cutting a small piece from a wiper, wadding the cut piece, and blowing the wadded piece through the tube by means of compressed air.

on a larger scale, plugs made of polyurethane foam or other polymeric foam have been used to clean the interior surfaces of pipe lines of large interior diameters, as exemplified in Wheaton U.S. Pat. No. 2,906,650, Knapp U.S. Pat. No. 3,277,508, and Knapp U.S. Pat. No. 5,032,185 . Plugs of related interest are exemplified in Bitter U.S. Pat. No. 3,119,600 and Hamrick U.S. Pat. No. 3,120,947.

Ideally, articles for cleaning metal, glass, or plastic surfaces in clean rooms should satisfy certain criteria. Such articles should he hydrophilic and static-dissipative. Particularly but not exclusively if used in clean rooms where semiconductors, magnetic storage media, or thin film circuits are produced, such articles should have very low counts of potentially destructive particles released in deionized water, particularly particles of a size greater than about 0.5 μm, and very low counts of potentially deleteterious ions released in deionized water, particularly chloride, fluoride, sodium, sulfate, sulfite or silicon ions. Heretofore, none of the wipers, rollers, or other cleaning articles available for cleaning metal, glass, or plastic surfaces in clean rooms have satisfied all of these criteria.

SUMMARY OF THE INVENTION

This invention provides a novel article useful for cleaning a metal, glass, or plastic surface without scratching or scoring the surface. The novel article is made from an open cell, hydrophilic, static-dissipative, polyurethane foam. The novel article is laundered so that the article in deionized water releases fewer than about $36.0\times10^6$ particles of a size greater than about 0.5 μm per square meter of apparent surface area of the article and fewer than about 2.5 parts per million of chloride, fluoride, sodium, sulfate, sulfite, or silicon ions. The novel article may be a wiper having a thin, sheet-like shape defining two broad faces, a sponge, a roller, a swab mounted on a handle, or a plug having a generally cylindrical shape when unstressed.

If the novel article is a wiper, the wiper is laundered so that the wiper in deionized water releases fewer than about $3.6\times10^6$ particles of a size greater than about 0.5 μm per square meter of apparent surface area of the broad faces. If the novel article is a swab, the swab is laundered so that the swab releases fewer than 550 particles of a size greater than about 0.5 μm . If the novel article is a plug, the plug is laundered so that the plug in deionized water releases fewer than about $6.7\times10^6$ particles of a size greater than about 0.5 μmper square meter of apparent surface area.

This invention also provides an improved method for cleaning a metal, glass, or plastic surface without scratching or scoring the surface. The improved method comprises wiping the surface with the novel article or washing the surface with deionized water and wiping the surface with the novel article. As employed in the improved method, the novel article may be a wiper having a thin, sheet-like shape defining two broad faces, a sponge, a roller, a swab mounted on a handle, or a plug having a generally cylindrical shape when unstressed, as described above.

If the wiped surface is the interior surface of a metal, glass, or plastic tube, the novel article employed to wipe the interior surface is such a plug, which is propelled through the tube, as by means of compressed air.

These and other objects, features, and advantages of this invention are evident from the following description of several embodiments of this invention with reference to the accompanying drawings.

DETAILED DESCRIPTION OF ILLUSTRATED EMBODIMENTS

This invention provides a novel article for cleaning a metal, glass, or plastic surface, as in a clean room, without scratching or scoring the surface. This invention contemplates that the novel article is made from an open cell, hydrophilic, static-dissipative, polyurethane foam.

Figure 1:
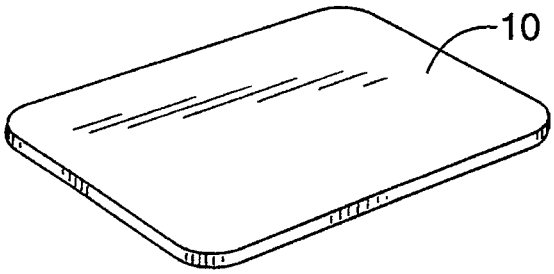
FIG. 1 is a perspective view of a wiper embodying this invention.

As shown in FIG. 1, the novel article may be a wiper 10 having a generally rectangular, sheet-like shape defining two broad surfaces and four rounded corners. The broad surfaces contribute most of the apparent surface area of the wiper 10.

It is convenient to disregard the edges of the wiper 10 when its apparent surface area is considered. The wiper 10 is made by die-cutting the wiper 10 from a larger, sheet-like piece of the open cell, hydrophilic, static-dissipative, polyurethane foam.

Figure 2:
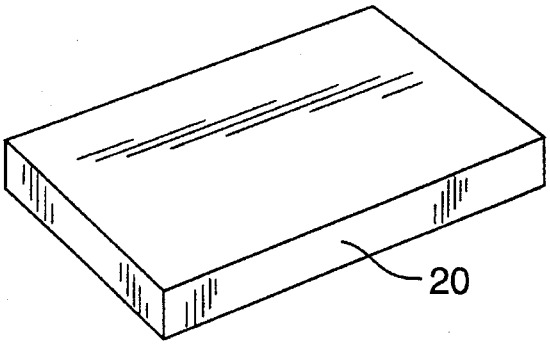
FIG. 2 is a perspective view of a sponge embodying this invention.

As shown in FIG. 2, the novel article may be a sponge 20 having a generally parallelepiped, slab-like shape defining two broad surfaces, two long sides, and two short ends. All of these faces, sides, and ends are regarded as contributing to the apparent surface area of the sponge 20. The sponge 20 is made by saw-cutting the sponge 20 from a larger, slab-like piece of the open cell, hydrophilic, static-dissipative, polyurethane foam.

Figure 3:
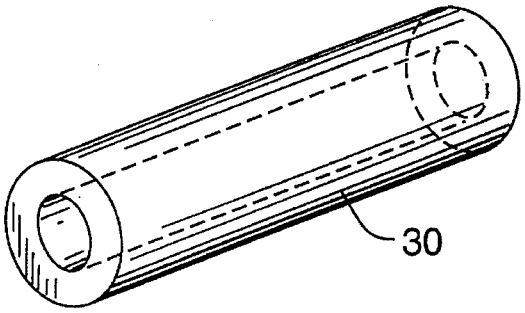
FIG. 3 is a perspective view of a roller embodying this invention.

As shown in FIG. 3, the novel article may be a roller 30 having a generally tubular shape defining an outer, cylindrical surface, an inner, cylindrical surface, and two annular ends. Ordinarily, as shown, the roller 30 is mounted on a metal or plastic spindle (not shown) extending through the roller 30. Therefore, the outer, cylindrical surfaces and the annular ends are regarded as contributing to the apparent surface area of the roller 30. The roller 30 is made by core-drilling followed by a buffing process.

Figure 4:
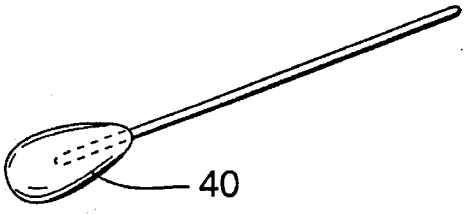
FIG. 4 is a perspective view of a swab mounted on a handle and embodying this invention.

As shown in FIG. 4, the novel article may be a swab 40, which is mounted on a handle. Preferably, the handle is made from polypropylene, and the swab 40 is heat-sealed to the handle. The apparent surface area that remains exposed when the swab 40 is mounted on the handle is regarded as the apparent surface area of the swab 40. The swab 40 is mounted on the handle, preferably by heat-sealing the foam material to the handle.

Figure 5:
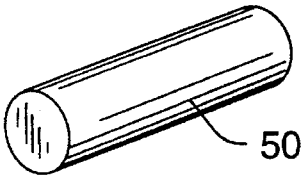
FIG. 5 is a perspective view of a plug embodying this invention.
Figure 6:
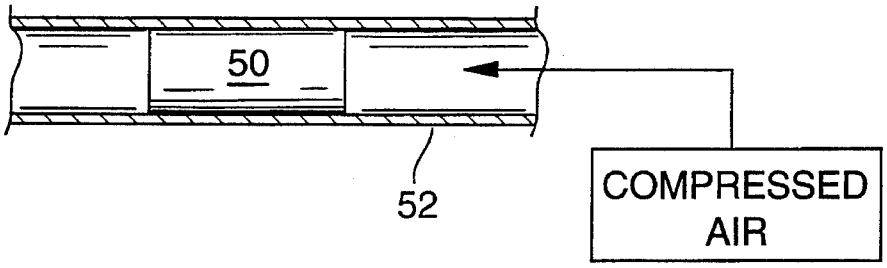
FIG. 6 is a schematic view showing a tube in axial cross-section and showing the plug being propelled through the tube by means of compressed air.

As shown in FIG. 5, the novel article may be a plug 50 having a generally cylindrical shape defining a generally cylindrical surface and two generally circular ends when the plug 50 is unstressed. The generally cylindrical surface and the generally circular ends contribute to the apparent surface area of the plug 50. The plug 50 is made by core-drilling the plug 50 from a larger, slab-like piece of the open cell, hydrophilic, static-dissipative, polyurethane foam.

Inherently, as compared to saw-cutting, die-cutting and core-drilling tend to cause less fragmentation of the polyurethane foam. Therefore, as compared to the sponge 20, the wiper 10, the roller 30, and the plug 50 tend to be initially cleaner in terms of potentially destructive particles.

This invention contemplates that the novel article is laundered, as described below, so as to minimize potential release of potentially destructive particles, particularly particles of a size greater than about 0.5 μm, and so as to minimize potential release of potentially deleterious ions, particularly chloride, fluoride, sodium, sulfate, sulfite, or silicon ions.

Specifically, the novel article is laundered so that the article in deionized water releases fewer than about $36.0\times10^6$ particles of a size greater than about 0.5 μm per square meter of apparent surface area of the article and fewer than about 2.5 parts per million of chloride, fluoride, sodium, sulfate, sulfite, or silicon ions, whether the novel article is a wiper, a sponge, a roller, a swab, or a plug. Moreover, the laundering process not only reduces the number of particles released from the article and reduces the residual chemical contaminants but also reduces the amount of total nonvolatile residue (TNVR) which would be released from the article during use.

Since die-cutting and core-drilling produce less fragmentation, as compared to saw-cutting, and since efficacy of laundering depends to a great extent on the article shape, the laundered article in deionized water releases even fewer particles if the novel article is a wiper, a swab, or a plug.

Thus, if the novel article is a wiper, the laundered wiper in deionized water releases fewer than about $3.6\times10^6$ particles of a size greater than about 0.5 μm per square meter of apparent surface area of the broad faces of the wiper. Also, if the novel article is a swab, the laundered swab releases fewer than about 550 particles of a size greater than about 0.5 μm. Also, if the novel article is a plug, the laundered plug in deionized water releases fewer than about $6.7\times10^6$ particles of a size greater than about 0.5 μm per square meter of apparent surface area of the plug.

Suitable open cell, hydrophilic, static-dissipative polyurethane foams useful to form the novel articles are commercially available from Time Release Sciences, Inc. of Niagara Falls, N.Y., under part No. 3270018. In practice, the polyurethane foam is provided in block form, commonly referred to as "buns", which is cut or configured to the various configurations which are described herein. The present invention contemplates that the foam is cut or configured by methods such as saw-cutting, die-cutting, and core-drilling so as to minimize producing particles and maximize retaining the open cell structure of the material.

Subsequent to cutting, the polyurethane foam is laundered to remove, to the maximum extent possible, particles which may have been produced during cutting and which have remained in the foam article as well as potentially deleterious ions.

The laundering process is unique for each type of product and varies as to laundering chemistry and wash cycle times. Generally, the laundering process uses a detergent suspended in various molar ratios, such as sodium oxalate, sodium oleate, sodium perchlorate, and sodium peroxydisulfate. The preferred molar ratios for laundering the novel articles described herein vary from about 1:64 to about 1:4. The detergent solution comprises no more than 0.002% of ions including chloride, bromide, sodium, and the like. Optionally, the detergent may include oxidants, buffers, and mild acid to optimize the material for specific applications.

The time of exposure of the material is critical for optimum cleanliness and varies dependent upon the particular article configuration. Preferred exposure times range from about 15 minutes for a small roller to about 45 minutes for a large roller. In the most preferred laundering process, the wipers are laundered in about a 1:16 molar ratio solution for about 30 minutes. The rollers are laundered in about a 1:4 molar ratio solution for about 45 minutes for a large roller and 15 minutes for a small roller. The swabs are laundered in about a 1:16 molar ratio solution for about 20 minutes, the sponges are laundered in about a 1:16 molar ratio solution for about 25 minutes to about 30 minutes, and the pipe plugs are laundered in about a 1:64 molar ratio solution for about 35 minutes. The preferred temperature range for the laundering process is between about 104° F. (40° C.) and about 149° F. (65° C.).

The polyurethane foam which is used to form the novel articles is a naturally static-dissipative material, that is, it is electrostatic discharge (ESD) safe. The polyurethane foam material has a surface resistivity in the range of about $10^7$ to about $10^8$ ohms/cm$^2$. Generally, materials which have surface resistivities which are less than about $\mathbf{10^{12}}$ ohms/cm$^2$ are considered ESD safe. Materials which have surface resistivities which are greater than about $\mathbf{10^{12}}$ ohms/cm$^2$ require treatment, such as by processing with surfactants, to lower the surface resistivity to acceptable levels.

The advantage of using a naturally static-dissipative material is that no material additives, such as surfactants, are required to achieve ESD safe levels of surface resistivity. A natural consequence of processing non-ESD safe materials is that such additives introduce contaminants into the material. Clearly, such contaminants may have deleterious effects on the overall efficacy of such clean room articles.

MATERIAL TESTING

Various types of tests were conducted to determine the efficacy of an article prepared in accordance with the principles of the present invention. The first type of test was directed toward determining the physical characteristics of the article, namely, to determine the number of particles released from samples of such articles under controlled, near zero mechanical stress conditions. These are the particle release tests. The sample articles which were tested included wipers, swabs, and pipe plugs.

The second type of test was directed toward determining the chemical characteristics of such an article, namely, the residuals of various, specific chemical ions and total non-volatile residue (TNVR) which remained in the articles after formation and which would be released therefrom when subjected to wetted conditions.

PARTICLE RELEASE TESTS

The particle release tests were performed to determine the number or count of particles which were released from articles of various configurations. The tested configurations included wipers, swabs, and pipe plugs.

wipers

In the wiper particle release test, deionized water was used as the testing medium. Supply water was passed through a series of decreasing pore size filters. The first such filter comprised a 5 μm roughing filter, the second filter comprised a 0.45 μm capsule filter, the third filter comprised a 0.22 μm capsule filter, and the fourth filter comprised two 0.20 μm fiber sterilizing filters.

In the exemplary wiper particle release test, a polyethylene tray was filled with 500 ml of deionized water. A wiper test sample was then placed in the tray. After the wiper was allowed to remain immersed in the water for several minutes, the water was decanted off and preserved in a 2000 ml flask. A second volume of 500 ml of water was then added to the tray containing the wiper. The wiper was again allowed to remain immersed in the water for several minutes, after which the water was decanted off and preserved in the flask. This process was repeated until a volume of water totalling about 2000 ml was collected.

The water was then tested to determine the number of particles which were released from the wiper. The particle count test was based upon a laser light scattering principle. The test instrument was a HIAC/ROYCO 4100/3200 laser particle counting system which employed a 346-BCL sensor was used.

The discharge water was tested for particles in 50 ml aliquots. Each aliquot was tested for particles in the size range of 0.5 μm to 25 μm. For each of the test runs, the results were averaged. The results of the test runs are shown in Table 1.

TABLE 1

| Wiper Particle Release Test | | | |
|---|---|---|---|
| | Area | Particles Released | |
| Test No. | ($cm^2$) | ($m^2$) | ($cm^2$) |
| 1 | 529 | 3,506,333 | 351 |
| 2 | 454 | 1,922,907 | 192 |
| 3 | 480 | 1,933,438 | 183 |

swabs

Five swab particle release tests were conducted. Tests 1 through 4 represent particle release values for the swabs of the present invention. Test 5 represents particle release values for experimental, non-production material.

In each of the swab particle release tests, deionized water was used as the test medium. Supply water was passed through a series of decreasing pore size filters. The first such filter comprised a 5 μm roughing filter, the second filter comprised a 0.45 capsule filter, the third filter comprised a 0.22 μm capsule filter, and the fourth filter comprised two 0.20 μm hollow fiber sterilizing filters.

A 200 milliliter (ml) flask was filled with 200 ml of deionized water. The water was continuously agitated by a magnetic stirrer and glass stir bar placed in the flask. A sample test grouping of ten swabs was immersed in the agitated water for ten minutes. A 25 ml aliquot of water was removed from the flask and tested for particles. This testing process was repeated three times for each test run.

The water was tested to determine the number of particles which were released from the swabs. The particle count test was based upon a laser light scattering principle. The test instrument was a HIAC/ROYCO 4100/3200 laser particle counting system which employed a 346-BCL sensor.

Each aliquot was tested for particles in the size ranges of 0.5 μm to 1.0 μm 1.0 μm to 3.0 μm 3.0 μm to 5.0 μm 5.0 μm to 10.0 μm 10.0 μm to 25.0 μm and over 25.0 μm. The results of each of the three samples were averaged to obtain a particle count for each test run for each particle size range. The particle count was then divided by 10 to obtain the particle count per single swab per 25 ml of water. A statistical number of particles was then calculated for the 200 ml test volume by multiplying the single swab particle count by 8. The results of Tests 1 through 5, which show the calculated statistical number of particles released per swab, are shown in Table 2.

TABLE 2

| Swab Particle Release Test | | | | | | |
|---|---|---|---|---|---|---|
| | Particle Size Ranae (microns) | | | | | |
| Test No. | 0.5–1.0 | 1.0–3.0 | 3.0–5.0 | 5.0–10.0 | 10.0–25.0 | >25.0 |
| 1 | 128 | 67 | 38 | 54 | 22 | 0 |
| 2 | 278 | 122 | 62 | 73 | 19 | 0 |
| 3 | 212 | 74 | 46 | 66 | 20 | 0 |
| 4 | 107 | 42 | 23 | 18 | 4 | 0 |
| 5 | 1529 | 158 | 87 | 42 | 12 | 0 |

Pipe Plugs

A pipe plug particle release test was conducted. Deionized water was used at the test medium. Supply water was passed through a series of decreasing pore size filters. The first such filter comprised a 5 μm roughing filter, the second filter comprised a 0.45 μm capsule filter, the third filter comprised a 0.22 μm capsule filter, and the fourth filter comprised two 0.20 μm hollow fiber sterilizing filters.

The pipe plug particle release test was conducted using a blank sample and a sample grouping of twenty plugs. Each plug in the sample of plugs tested had an average of 5.34 $cm^2$ of apparent surface area. The blank sample test was performed using the same procedure as that used in the pipe plug test.

A polyethylene tray was filled with 500 ml of deionized water. The pipe plug samples were placed into the water in the tray using forceps to prevent contamination. The pipe plug samples were thoroughly wetted with minimal agitation of the water. The water in the tray was then decanted into a 2000 ml flask. A second volume of 500 ml of water was then poured into the tray. The plug samples were again wetted with the second volume of water and the water was decanted into the flask. This process was repeated two additional times to produce about a 2000 ml liquid sample. During the course of the test, the water in the flask was continuously stirred by a magnetic stirrer and glass stir bar placed in the flask.

Four 50 ml aliquots were withdrawn from the flask and each sample of water was tested to determine the number of particles which were released from the pipe plugs. The particle count test was based upon a laser light scattering principle. The test instrument used was a HIAC/ROYCO 4100/3200 laser particle counting system which employed a 346-BCL sensor. Each aliquot was tested for particles in the size range of 0.5 μm to 25.0 μm.

The blank sample test was performed using the same procedure as that used in the pipe plug particle release test, however, no plug samples were placed in the tray. In the blank sample test, two 50 ml aliquots were withdrawn and tested for particles. The blank sample test provided a control for the pipe plug test.

The test showed that on average, each plug in the sample contributed about $0.33\times10^6$ particles per square meter of apparent surface area.

RESIDUAL CHEMICAL TESTS

Various chemical tests were performed on the articles to determine the type and quantity of residual chemical contaminants which remained in the articles after formation and which were released when subjected to various wetted conditions. These are the extraction tests. Of particular interest were contaminants such as chloride, sulfate, sulfite, sodium, fluoride, silicon, and total nonvolatile residue ("TNVR").

The articles were tested under different wetted environments which were representative of anticipated working conditions. These wetted environments were simulated by testing the articles in liquids such as deionized water ("DI"), isopropyl alcohol ("IPA"), acetone, freon, and methanol.

In the extraction tests results shown, the method detection limit ("MDL") for the respective test, for each contaminant, is shown. Test times are shown as 10 m for time periods of ten minutes and 2 h for time periods of two hours. Where the contaminant was not detected in the analysis or the contaminant level was below the MDL, "ND "is shown as the result. The results of these tests are summarized in Tables 3 through 9.

TABLE 3

| | | Sulfate Release Test | | | | | |
|---|---|---|---|---|---|---|---|
| Solvent | Time | MDL (μg) | Area ($cm^2$) | μg/ wiper | μg/ $cm^2$ | $g/m^2$ | μg/g (ppm) |
| DI | 10 m | 200 | 462 | ND | ND | ND | ND |
| | 2 h | 20 | — | ND | ND | ND | ND |
| IPA | 2 h | 20 | — | ND | ND | ND | ND |
| Acetone | 2 h | 20 | — | ND | ND | ND | ND |
| Freon TF | 2 h | 20 | — | ND | ND | ND | ND |

TABLE 4

| | | Sulfate Release Test | | | | | |
|---|---|---|---|---|---|---|---|
| Solvent | Time | MDL (μg) | Area ($cm^2$) | μg/ wiper | μg/ $cm^2$ | $g/m^2$ | μg/g (ppm) |
| DI | 10 m | 200 | 462 | ND | ND | ND | ND |
| | 2 h | 40 | 445 | 92 | 0.21 | 0.002 | — |
| | 2 h | 20 | 437 | ND | ND | ND | ND |
| IPA | 2 h | 40 | 454 | 462 | 1.02 | 0.01 | — |
| Acetone | 2 h | 40 | 441 | 185 | 0.42 | 0.004 | — |
| Freon TF | 2 h | 40 | 454 | ND | ND | ND | ND |

TABLE 5

| | | Chloride Release Test | | | | | |
|---|---|---|---|---|---|---|---|
| Solvent | Time | MDL (μg) | Area ($cm^2$) | μg/ wiper | μg/ $cm^2$ | $g/m^2$ | μg/g (ppm) |
| DI | 10 m | 200 | 462 | ND | ND | ND | ND |
| | 10 m | 2[1] | 449[2] | 260 | 0.58 | — | 42.4 |
| | 2 h | 20 | 445 | 209 | 0.47 | 0.005 | — |
| | 2 h | 2[1] | 437[3] | 130 | 0.3 | — | 15.9 |
| IPA | 2 h | 20 | 454 | 70 | 0.15 | 0.002 | — |
| Acetone | 2 h | 20 | 441 | 232 | 0.53 | 0.005 | — |
| Freon TF | 2 h | 20 | 454 | ND | ND | ND | ND |

Notes:
[1]MDL in shown in μg/wipe
[2]Sample weight was 6.13 g
[3]Sample weight was 8.17 g

TABLE 6

| | | Sodium Release Test | | | | | |
|---|---|---|---|---|---|---|---|
| Solvent | Time | MDL (μg) | Area ($cm^2$) | μg/ wiper | μg/ $cm^2$ | $g/m^2$ | μg/g (ppm) |
| DI | 10 m | 0.2[4] | 449[5] | 49.8 | 0.11 | — | 8.12 |
| | 2 h | 0.2[4] | 437[6] | 31 | 0.07 | — | 3.8 |
| | 2 h | 0.6 | 445 | 73.3 | 0.16 | 0.002 | — |
| IPA | 2 h | 0.6 | 454 | ND | ND | ND | ND |
| Acetone | 2 h | 0.6 | 441 | 315 | 0.71 | 0.007 | — |
| Freon TF | 2 h | 0.6 | 454 | ND | ND | ND | ND |

Notes:
[4]MDL value is shown in μg/wipe

TABLE 6-continued

| Sodium Release Test | | | | | | | |
|---|---|---|---|---|---|---|---|
| Solvent | Time | MDL (μg) | Area ($cm^2$) | μg/ wiper | μg/ $cm^2$ | $g/m^2$ | μg/g (ppm) |

[5]Sample weight was 6.13 g
[6]Sample weight was 8.17 g

TABLE 7

| Silicone Release Test | | | | | | | |
|---|---|---|---|---|---|---|---|
| Solvent | Time | MDL (μg) | Area ($cm^2$) | μg/ wiper | μg/ $cm^2$ | $g/m^2$ | μg/g (ppm) |
| DI | 10 m | 2 | 462 | 11 | 0.02 | — | — |
| | 2 h | 2 | 445 | 16 | 0.04 | 0.0003 | — |
| IPA | 10 m | 2 | 441 | 25 | 0.06 | — | — |
| | 2 h | 2 | 454 | ND | ND | ND | ND |
| Acetone | 2 h | 2 | 441 | ND | ND | ND | ND |
| Freon TF | 2 h | 2 | 454 | ND | ND | ND | ND |
| Methanol | 10 m | 2 | 449 | 3 | 0.007 | — | — |

TABLE 8

| Fluoride Release Test | | | | | | | |
|---|---|---|---|---|---|---|---|
| Solvent | Time | MDL (μg) | Area ($cm^2$) | μg/ wiper | μg/ $cm^2$ | $g/m^2$ | μg/g (ppm) |
| DI | 10 m | 2 | 449 | ND | ND | ND | ND |
| | 2 h | 2 | 437 | ND | ND | ND | ND |

TABLE 9

| Total Non-Volatile Residue (TNVR) Release Test | | | | | | | | |
|---|---|---|---|---|---|---|---|---|
| Solvent | Time | MDL (μg) | Area ($cm^2$) | μg/ wiper | μg/ $cm^2$ | mg/ $m^2$ | μg/ gm | μg/ ea |
| DI | 10 m | 1000 | —[7] | — | — | — | ND | ND |
| | 10 m | 2000 | 462 | ND | ND | ND | — | — |
| | 2 h | 2000 | 445 | 3840 | 8.62 | — | — | — |
| IPA | 10 m | 1000 | —[7] | — | — | — | ND | ND |
| | 10 m | 2000 | 441 | 2400 | 5.44 | 54.4 | — | — |
| | 2 h | 2000 | 454 | 3770 | 8.30 | — | — | — |
| Acetone | 2 h | 2000 | 441 | 3010 | 6.83 | — | — | — |
| Freon TF | 2 h | 2000 | 454 | 2550 | 5.6 | — | — | — |
| Methanol | 10 m | 1000 | —[7] | — | — | — | 445 | 2560 |
| | 10 m | 2000 | 449 | 3160 | 7.04 | 70.4 | — | — |

Notes:
[7]Sample weight was 5.75 g

The sulfate and sulfite release tests (the results of which are shown in Tables 3 and 4, respectively) were performed using standard ion chromatography test methods. The chloride and fluoride release tests (the results of which are shown in Tables 5 and 8, respectively) were performed using standard titration test methods which used mercuric nitrate as the titrant. The sodium release test (the results of which are shown in Table 6) was performed using standard ion chromatography test methods. The silicon release test (the results of which are shown in Table 7) was performed using standard colorimetric test methods. The TNVR release test (the results of which are shown in Table 9) was performed using standard gravimetric test methods.

We claim:

1. A method for cleaning a metal, glass, or plastic surface without scratching or scoring the surface, in a clean room where semiconductors, magnetic storage media, or thin film circuits are produced or where pharmaceuticals are produced, which method comprises wiping the surface with an article made from an open cell, hydrophilic, static-dissipative, polyurethane foam the article having been laundered so that the article, if tested by being immersed in deionized water, releases fewer than about $36.0\times10^6$ particles of a size greater than about 0.5 μm per square meter of apparent surface area of the article and fewer than about 2.5 parts per million of chloride, fluoride, sodium, sulfate, sulfite, or silicon ions, thereby minimizing potential release of potentially destructive particles and of potentially destructive ions.

2. The method of claim 1 wherein the article is a wiper, which has a thin, shape defining two broad surfaces, and which is laundered so that the wiper, if immersed in deionized water, releases fewer than about $3.6\times10^6$ particles of a size greater than about 0.5 μ per square meter of apparent surface area of the broad surfaces.

3. The method of claim 1 wherein the article is a sponge.

4. The method of claim 1 wherein the article is a roller.

5. The method of claim 1 wherein the article is a swab, which is laundered so that the swab if immersed in deionized water, releases fewer than about 550 particles of a size greater than about 0.5 μm, and which is mounted on a handle.

6. The method of claim 1 wherein the wiped surface is the interior surface of a metal, glass, or plastic tube, and wherein the article is a plug, which is laundered so that the plug if tested by being immersed in deionized water, releases fewer than about $6.7\times10^6$ particles of a size greater than about 0.5 μm per square meter of apparent surface area of the plug, which has a cylindrical shape when unstressed, and which is propelled through the tube.

7. The method of claim 1 wherein the article is laundered in a detergent in a molar ratio from about 1:64 to about 1:4 in a solution comprising no more than about 0.002% of chloride, bromide, or sodium ions.

8. A method for cleaning a metal, glass, or plastic surface without scratching or scoring the surface, in a clean room where semiconductors, magnetic storage media, or thin film circuits are produced or where pharmaceuticals are produced, which method comprises washing the surface with deionized water and wiping the surface with an article made from an open cell, hydrophilic, static-dissipative, polyurethane foam the article having been laundered so that the article, if tested by being immersed in deionized water, releases fewer than about $36.0\times10^6$ particles of a size greater than about 0.5 μm per square meter of apparent surface area of the article and fewer than about 2.5 parts per million of chloride, fluoride, sodium, sulfate, sulfite, or silicon ions, thereby minimizing potential release of potentially destructive particles and of potentially destructive ions.

9. The method of claim 8 wherein the wiped surface is the interior surface of a metal, glass, or plastic tube, and wherein the article is a plug, which is laundered so that the plug, if tested by being immersed in deionized water releases fewer than about $6.7\times10^6$ particles of a size greater than about 0.5 μm per square meter of apparent surface area of the plug, which has a cylindrical shape when unstressed, and which is propelled through the tube.

10. The method of claim 8 wherein the article is laundered in a detergent in a molar ratio from about 1:64 to about 1:4 in a solution comprising no more than about 0.002% of chloride, bromide, or sodium ions.

* * * * *